US005199371A

United States Patent [19]

Meriwether

[11] Patent Number: 5,199,371

[45] Date of Patent: Apr. 6, 1993

[54] DECK STRUCTURE FOR FLOATING DOCK

[75] Inventor: Jon D. Meriwether, Follansbee, W. Va.

[73] Assignee: The Louis Berkman Company, Steubenville, Ohio

[21] Appl. No.: 811,845

[22] Filed: Dec. 23, 1991

[51] Int. Cl.[5] ..... B63B 35/44

[52] U.S. Cl. ..... 114/267; 405/219

[58] Field of Search ..... 114/263, 264, 266, 267; 405/218, 219

[56] References Cited

U.S. PATENT DOCUMENTS

| | | | |
|---|---|---|---|
| 3,103,907 | 9/1963 | Scholley | 114/266 |
| 3,147,727 | 9/1964 | Weiss, Jr. et al. | 114/266 |
| 3,635,181 | 1/1972 | Epple et al. | 114/266 |
| 3,752,102 | 8/1973 | Shuman | 114/0.5 R |
| 4,316,426 | 2/1982 | Meeusen | 405/219 X |
| 4,655,156 | 4/1987 | Svirklys | 114/266 |
| 4,683,833 | 8/1987 | Meriwether | 114/267 |
| 4,709,647 | 12/1987 | Rytan | 114/267 |
| 4,799,445 | 1/1989 | Meriwether | 114/267 |
| 4,974,538 | 12/1990 | Meriwether | 114/267 |

FOREIGN PATENT DOCUMENTS 2351314 4/1975 Fed. Rep. of Germany ..... 114/267

*Primary Examiner*—Sherman Basinger

*Attorney, Agent, or Firm*—Body, Vickers & Daniels

[57] ABSTRACT

A deck structure for a floating dock is comprised of a rectangular frame having opposite sides and opposite ends defined by interconnected C-shaped channel members facing inwardly of the frame and a plurality of cross members between and interconnected with the sides of the frame and constructed from C-shaped metal channel. The cross members have upper flanges spaced below the upper flanges of the side and end members of the frame, and deck units of wood material rest on the flanges of the cross members between the upper flanges of the side and end members of the frame which restrain displacement of the deck units relative to the frame in the directions between the opposite sides and opposite ends of the frame. The deck units have upper surfaces coplanar with the upper flanges of the frame, and the deck units are movable as such from the frame to provide access to passageways provided in the frame beneath the decking to accommodate utility lines and the like. The underside of the frame is adapted to be secured to float drums to provide a floating dock.

37 Claims, 5 Drawing Sheets

DECK STRUCTURE FOR FLOATING DOCK

BACKGROUND OF THE INVENTION

The present invention relates to the art of floating docks and, more particularly, to an improved deck structure for a floating dock.

Floating docks are of course well known and, generally, are comprised of a deck structure suitably secured to underlying sealed metal drums, styrofoam floats, hollow or foam filled plastic floats and the like. Examples of floating docks using hollow or cored plastic float drums and the structures of such drums are disclosed in my prior U.S. Pat. Nos. 4,683,833; 4,799,445; and 4,974,538 which are incorporated herein by reference. As disclosed in the earlier two of my foregoing patents, a floating dock may be comprised of a plurality of dock sections suitably interconnected to provide a floating dock assembly, and the deck structure for each dock section is comprised of a rectangular frame having side and end members of wood or metal, and decking in the form of wooden deck boards. The deck boards have opposite ends overlying and secured to the side members of the frame, whereby the frame and decking is a unitary structure. In such prior deck structures, rigid fastening of the opposite ends of the deck boards to the side members of the frame is often necessary to assure rigidity and structural integrity with respect to the deck structure. In order to provide boaters using the dock with utilities such as electricity and water, lines for the latter can be supported beneath the decking such as by an electrical raceway and/or waterlines secured to the underside of the deck boards or to the insides of the side and end members of the frame. If the frame is constructed from metal members, a wooden bump board is usually secured at least to the outer sides of the side members of the frame, and cleats are secured to the top sides of the deck boards to facilitate the tying of boats to the dock.

When it becomes necessary or desirable to access the interior of the deck structure beneath the deck boards for purposes of, for example, inspection, maintenance and/or replacement with respect to the frame components, float drums and/or utility lines, such access is both difficult and time consuming to achieve. In this respect, each of the deck boards must be removed from the frame in the area of the floating dock to be accessed, and this requires removing the individual fasteners such as screws or bolts by which the deck boards are secured to the underlying frame members. Both the difficulty and normal time required to remove such fasteners can be increased if the fasteners have rusted, and if the deck cleats span two adjacent deck boards then the cleats also have to be removed. Moreover, the deck boards have to be replaced following the inspection, maintenance or other operation necessitating access to the interior of the deck structure, and such replacement is likewise time consuming and tedious. If the utility lines are secured to the undersides of the deck boards, even more time is required because of the care which has to be taken to preclude damaging the lines.

SUMMARY OF THE INVENTION

In accordance with the present invention, a deck structure is provided for a floating dock which advantageously overcomes the foregoing problems in connection with accessing the interior of the deck structure. More particularly in this respect, a deck structured in accordance with the present invention is comprised of a rigid frame assembly supporting one or more deck units in a manner whereby the latter rest on components of the frame, are restrained from displacement relative to the frame in the directions between the sides and ends thereof, and are freely displaceable vertically of the frame to facilitate the removal thereof from the frame and thus substantially immediate access to the interior of the deck structure therebeneath. For example, in a dock section in which the frame is 6 feet wide and 30 feet long, the decking can be provided by three individually removable deck units each having a width corresponding to the distance between the side members of the frame and having a combined length corresponding to the distance between the end members of the frames. Each deck unit is readily removed simply by elevating the latter above the frame, whereby access to any part of the interior of the frame structure or to the entirety thereof is readily achievable.

Further in accordance with the present invention, the frame is comprised of side and end frame members having upper ends and cross members extending between the side members and having upper ends spaced below the upper ends of the side and end frame members. This construction provides the frame with an upwardly open recess area in which the deck unit or units are received and confined laterally and longitudinally of the frame. The deck units rest on the upper ends of the cross members and, when so positioned, provide an upper deck surface which preferably is coplanar with the upper ends of the side and end frame members. The deck units, which are preferably of wood, may be of planar sheet construction having a thickness corresponding to the distance between the upper ends of the cross members and the upper ends of the side and end members of the frame, or of a construction providing stringers extending in the direction between the opposite ends of the frame and deck boards overlying and secured to the stringers and extending in the direction between the opposite sides of the frame. Preferably, the sides and ends of the frame are provided with supports underlying the corresponding sides and ends of the deck units to add stability to the latter when in place on the frame. Utility lines can be supported within the frame such as by troughs between the cross members and, accordingly, the utility lines are readily accessible upon removing the overlying deck unit or units.

It is accordingly an outstanding object of the present invention to provide an improved deck structure for a floating dock.

Another object is the provision of a deck structure of the foregoing character comprised of a frame and one or more deck units readily removable therefrom to provide access to the interior of the deck.

A further object is the provision of a deck structure of the foregoing character wherein the frame is constructed to provide a recessed area receiving the deck unit or units which interengage with sides and ends of the recessed area to restrain displacement of each deck unit in the directions between the sides and ends of the frame and in which each deck unit is adapted to be elevated and removed from the recessed area to provide access to the interior of the frame.

Yet another object is the provision of a deck structure of the foregoing character which does not rely on the deck unit or units for obtaining structural integrity for the deck structure.

Still a further object is the provision of a deck structure of the foregoing character which substantially reduces the time and effort heretofore required to gain access to the interior of the frame, and thus reduces the time and effort required in connection with the performance of maintenance or replacement with respect to utility lines or the like supported in the frame beneath the decking.

BRIEF DESCRIPTION OF THE DRAWINGS

The foregoing objects, and others, will in part be obvious and in part pointed out more fully hereinafter in conjunction with the written description of preferred embodiments of the invention illustrated in the accompanying drawings in which.

DESCRIPTION OF PREFERRED EMBODIMENTS

Figure 1:
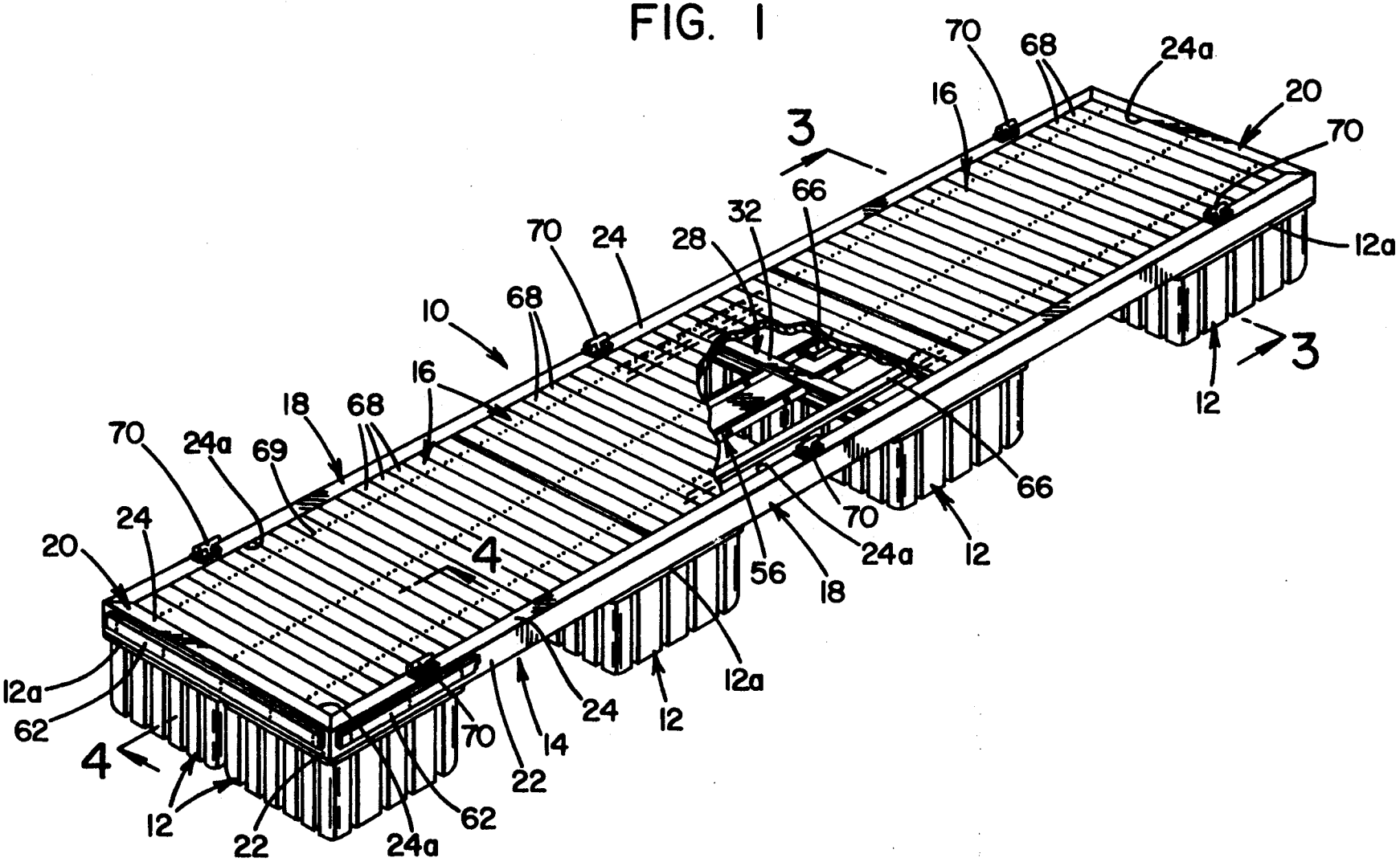
FIG. 1 is a perspective view of a floating dock having a deck structure in accordance with the present invention.

Referring now in greater detail to the drawings wherein the showings are for the purpose of illustrating preferred embodiments of the invention only and not for the purpose of limiting the invention, FIG. 1 illustrates a floating dock comprising a deck 10 and a plurality of float drums 12 secured to the deck in underlying relationship thereto. Preferably, float drums 12 are of any one of the structures disclosed in my aforementioned patents. At the same time, however, it will be appreciated that any suitable float drum structure can be employed with a deck structure according to the present invention. Deck 10 is comprised of a frame 14 and a plurality of individual deck units 16 which rest on and interengage with frame 14 in the manner set forth more fully hereinafter and which are individually removable from the frame simply by elevating the deck unit therefrom.

Figure 2:
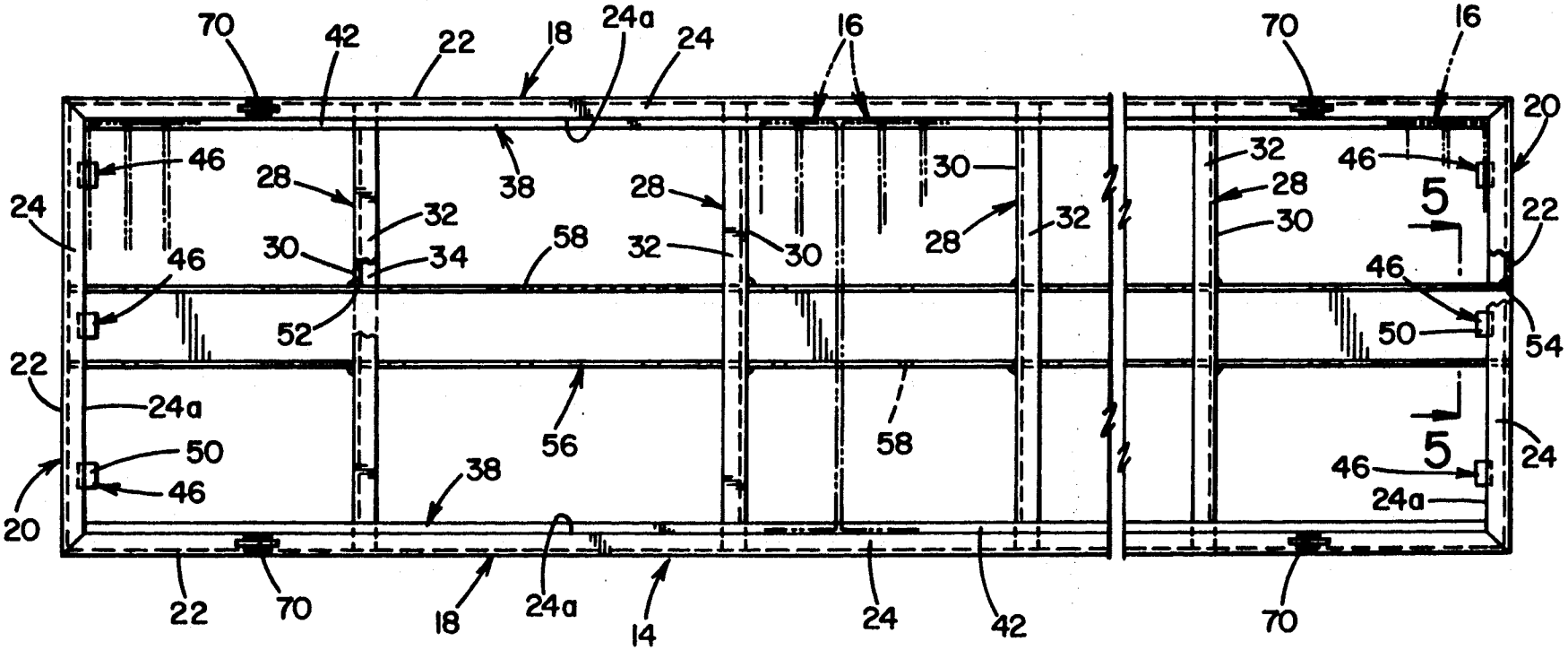
FIG. 2 is a plan view of the frame of the deck structure with the deck units removed.

Referring now in particular to FIGS. 1-5 of the drawing, frame 14 has opposite sides and opposite ends respectively defined by a pair of spaced apart parallel side members 18 and a pair of parallel spaced apart end members 20. Preferably, each of the side and end members 18 and 20 is a galvanized steel channel member which is C-shaped in cross-section. The side and end frame members are disposed for the corresponding channel to open inwardly of the frame, and the opposite ends of the side and end members are suitably interconnected such as by mitering the ends as shown in FIGS. 1 and 2 and welding the mitered ends together. When so interconnected, each of the channel members 18 and 20 has a vertical web 22 and parallel upper and lower flanges 24 and 26, respectively. The channels from which frame members 18 and 20 are constructed are of the same size in cross-section and, when interconnected, upper flanges 24 are coplanar as are lower flanges 26.

Frame 14 further includes a plurality of cross members 28 between side members 18. Cross members 28 are spaced apart in the direction between end members 20 and are parallel to one another and to the end members. Cross members 28 are also preferably constructed from galvanized steel channel members which are C-shaped in cross-section providing each of the cross members with a vertical web 30 and parallel upper and lower flanges 32 and 34, respectively. The opposite ends of each of the cross members extends into the corresponding side member 18, and a portion of lower flange 34 is cut away to provide a notch 36 receiving lower flange 26 of the corresponding side member so that lower flanges 34 of the cross members are coplanar with lower flanges 26 of the side members. The opposite ends of the web and upper flange of each of the cross members 28 abut against the inner side of web 22 of the corresponding side member 18, and the opposite ends of the cross members are suitably interconnected with the side members, such as by welding. Cross members 28 are of the same vertical height and are vertically shorter than the side and end members 18 and 20, whereby upper flanges 32 of the cross members are coplanar and lie in a plane parallel to and spaced below the plane of upper flanges 24 of the side and end members.

The foregoing structural relationship between the side, end and cross members of frame 14 provide the frame with a recessed area between the opposite sides and ends thereof and which recessed area has a bottom defined by the upper flanges 32 of the cross members. The recessed area also has a peripheral wall defined by the laterally inner end edges 24*a* of upper flanges 24 of the side and end members, which peripheral wall serves the purpose set forth hereinafter. Preferably, for the purpose set forth hereinafter, support members 38 extend along the length of each of the side members 18 of the frame and are secured to upper flange 24 of the corresponding side member and upper flanges 32 of the cross members adjacent corresponding side of the frame. In the embodiment illustrated, each of the support members 38 includes an upper leg 40 secured to the underside of the corresponding flange 24, such as by welding, an intermediate leg 42 extending laterally inwardly of inner end edge 24*a* of the corresponding upper flange 24, and a lower leg 44 extending down and secured to the underlying cross member 30, such as by welding. Legs 42 of the support members along opposite sides of the frame are coplanar in a plane spaced below the plane of upper flanges 24 and above the plane of upper flanges 32 of cross members 28. Preferably, for the purpose set forth more fully hereinafter, end members 20 of the frame are provided with support members 46. Each support member 46 includes a vertical leg 48 secured to the underside of upper flange 24 of the corresponding end member, such as by welding, and a leg 50 extending laterally inwardly of edge 24*a* of upper flange 24. Legs 50 are coplanar with one another and with upper flanges 32 of cross members 28.

Further in connection with the embodiment illustrated in FIGS. 1-5, cross members 28 are provided with rectangular openings 52 therethrough, and the end member 20 at the right of the frame in FIG. 2 is provided with a rectangular opening 54, which openings 52 and 54 accommodate a channel-shaped utility trough 56 of metal or plastic. These openings and trough 56 facilitate the introduction of utility lines such as waterlines and electrical conductors, not illustrated, to the interior of the deck structure and the support of the utility lines therein. Such utility lines are of course provided to supply the utilities to boats using the floating dock, and trough 56 may be provided with suitable openings 58 through the side walls thereof to accommodate extensions of the utility lines to the laterally opposite sides of the deck along the length thereof.

Float tanks 12 are suitably secured to the underside of frame 14 such as by nut and bolt assemblies 60 extending through openings therefor in flanges 12*a* of the float tank and in lower flanges 34 of cross member 28 and, with respect to the float drums at the opposite ends of the frame, openings in lower flanges 26 of end members 20. Preferably, webs 22 of side and end frame members 18 and 20 are provided with corresponding bumpboards 62 suitably secured thereto such as by nut and bolt assemblies 64, which bumpboards may for example be 2"×6" boards which serve, as is well known, to protect the dock and boats from damage resulting from contact therebetween.

Further in accordance with the present invention, deck units 16 are adapted to be supported by frame 14 within the recessed area thereof and, in the embodiment illustrated in FIGS. 1–5, each of the deck units 16 is defined by a plurality of stringer members 66 which extend in the direction between the opposite ends of the frame and which are parallel and spaced apart in the direction between the side members of the frame. Stringers 66 are preferably defined by 2"×4" wood members, and each deck unit further includes a plurality of closely spaced deck boards 68 extending between side members 18 of the frame in overlying relationship with respect to stringers 66. Deck boards 68 are preferably 2"×6" wood members, each of which is fastened to the underlying stringers such as by screws 69. Stringers 66 rest on upper flanges 32 of cross members 28 and, at the ends of the deck units adjacent end members 20 of the frame, stringers 66 rest on legs 50 of support members 46.

The opposite ends of deck boards 68 are adjacent inner edge 24*a* of upper flange 24 of the corresponding side member 18 and rest on leg 42 of the corresponding support member 38. The endmost deck members 68 adjacent end members 20 of the frame are adjacent inner end edges 24*a* of flanges 24 of the corresponding end frame member 20, and the upper sides of deck members 68 provide for the deck unit to have a top surface which is generally coplanar with the upper side of upper flanges 24 of side and end frame members 18 and 20. It will be appreciated from the foregoing description that the deck units, in resting on cross members 28 and support members 38 and 46 are detached from and slidable relative to the frame and that sliding displacement of the deck units longitudinally and laterally of the frame is restrained by interengagement between the deck units and inner edges 24*a* of upper flanges 24 of the frame. It will likewise be appreciated that each of the deck units is readily removable from the frame merely by elevating the deck unit from its resting position on the frame, thus providing access to the interior of the frame and in particular to the utility lines supported therein.

Figure 3:
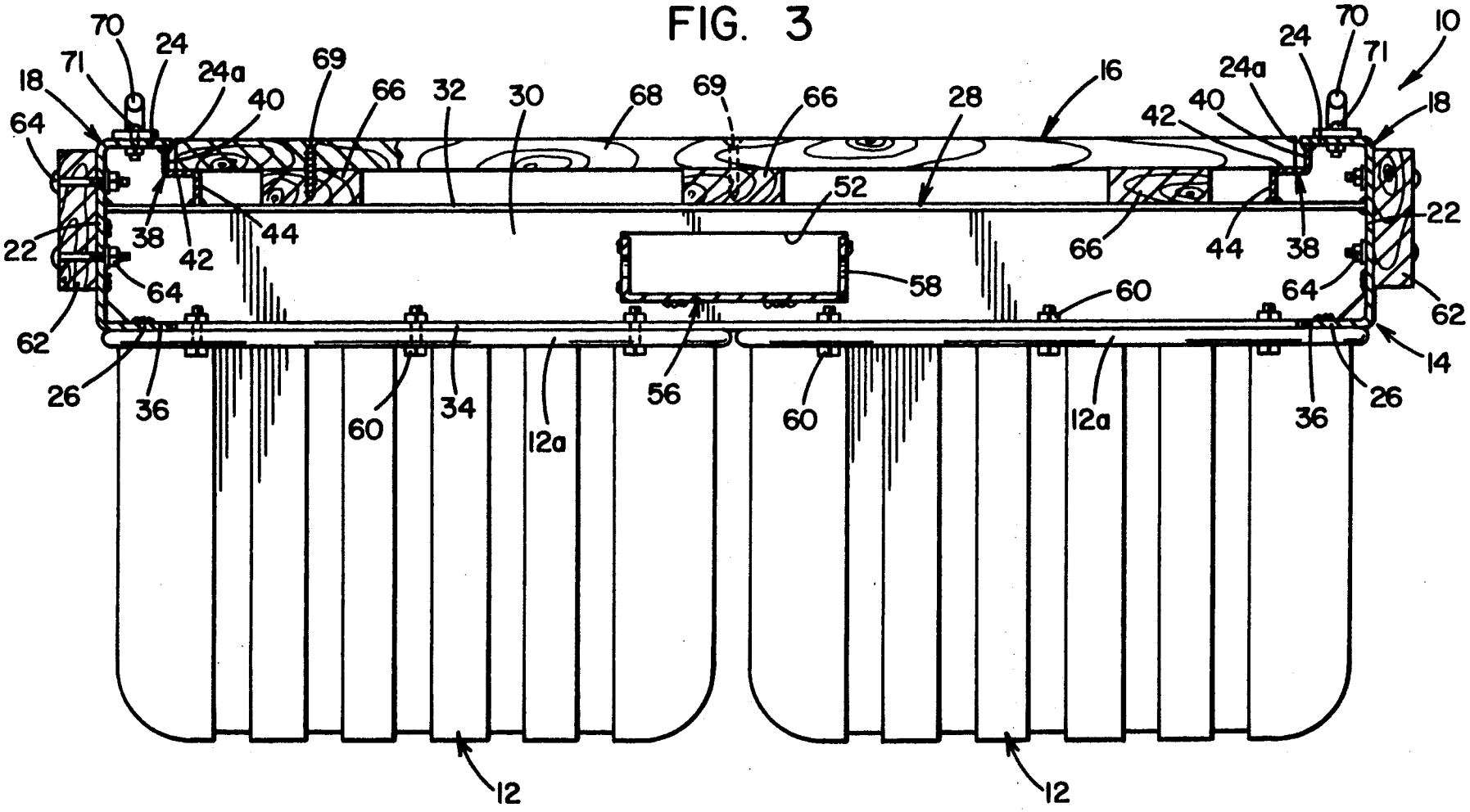
FIG. 3 is a cross-sectional elevation view of the deck structure taken along line 3—3 in FIG. 1.
Figure 4:
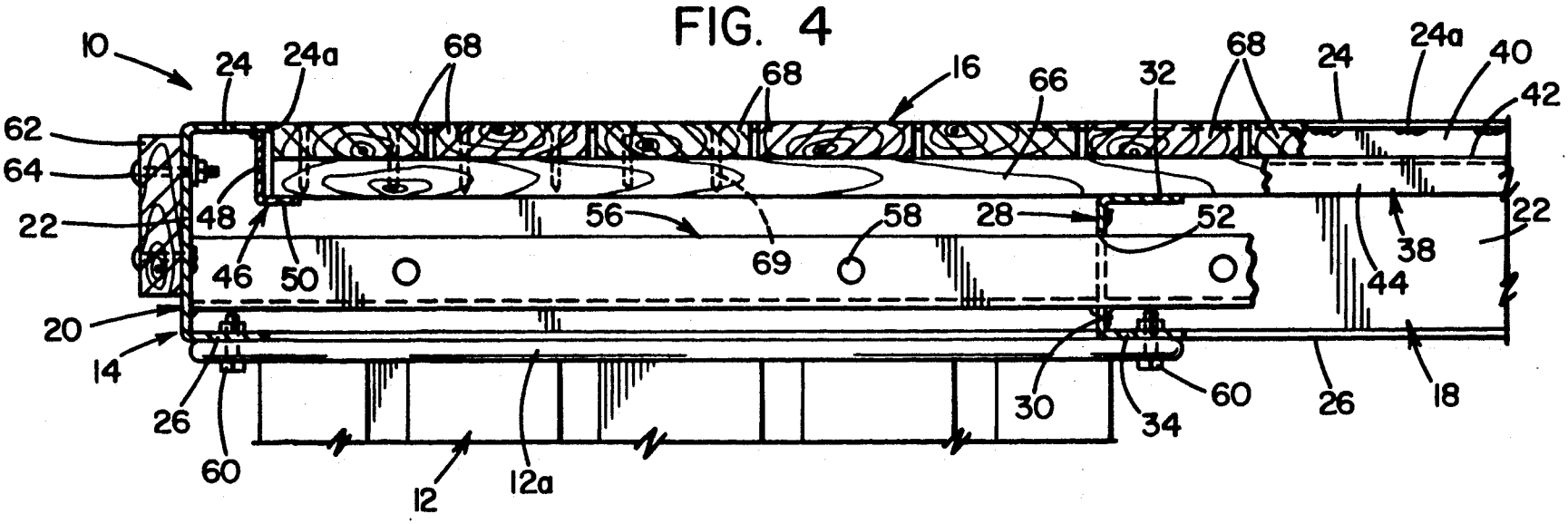
FIG. 4 is a cross-sectional elevation view of the deck structure taken along line 4—4 in FIG. 1.
Figure 5:
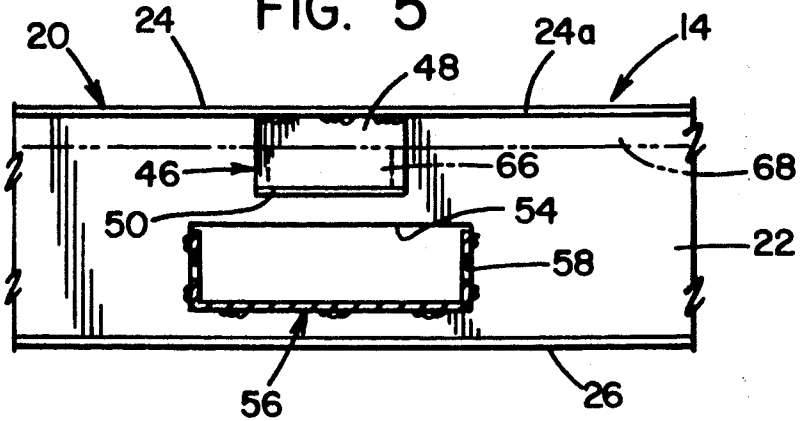
FIG. 5 is a cross-sectional elevation view through the frame taken along line 5—5 in FIG. 2; and, FIG. 6 is a cross-sectional elevation view similar to the left hand side of FIG. 3 and showing another embodiment of the frame and a deck unit of a deck structure in accordance with the invention.

The rigidity of the frame of the deck structure advantageously facilitates the mounting of cleats on the frame to facilitate tying boats to the dock, such as the cleats 70 illustrated in FIGS. 1 and 3 as being mounted on top flanges 24 of the side members of the frame by corresponding nut and bolt assemblies 71. Thus, removal of one or more of the deck sections 16 from the frame does not require removal of the cleats and, moreover, can be achieved while a boat or boats are tied to the dock.

Figure 6:
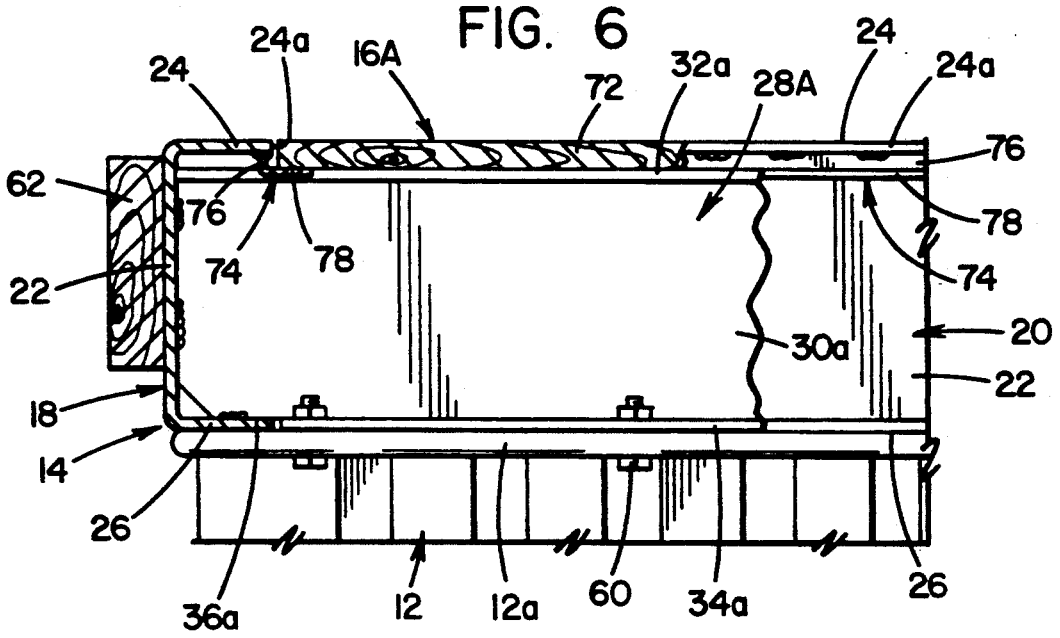

Referring now to FIG. 6, there is illustrated a modification of the deck structure in which a deck unit designated 16A is in the form of a sheet of wood 72 which could, for example, be ¾" plywood. In this embodiment, frame parts corresponding to the frame illustrated and described hereinabove with regard to FIGS. 1–5 are identified by like numerals. In order for the latter frame to accommodate a deck unit or units in the form of wood sheet material, the cross members of the frame and the support members along the sides and ends thereof are modified. In this respect, the cross members, designated 28A in FIGS. 6, are C-shaped channel members as in the earlier embodiment having a vertical web 30*a*, and upper and lower flanges 32*a* and 34*a*, respectively. The lower flanges 34*a* at the opposite ends of the cross members are cut away to provide notches 36*a* as and for the purpose described hereinabove in connection with the earlier embodiment. Cross members 28*a* are vertically shorter than the side and end frame members as in the earlier embodiment and, in this respect, upper flanges 32*a* of the cross members are spaced below upper flanges 24 of the side and end members of the frame a distance corresponding to the thickness of wood sheet 72. Accordingly, when the deck unit defined by sheet 72 is in place resting on the upper flanges of the cross members, the upper surface of the deck unit is coplanar with the upper surface of upper flanges 24 of the frame members.

Further in connection with the embodiment in FIG. 6, side support members 74 are secured to the undersides of upper flanges 24 and include a leg 76 secured to the underside of the flange, such as by welding, and a leg 78 extending inwardly of edge 24*a* of the flange in underlying relationship with the corresponding side edge of deck sheet 72. It will be appreciated from FIG. 6 that side support members 74 are in individual strips between adjacent ones of the cross members 28A and that the upper sides of legs 78 are coplanar with the upper sides of upper flanges 32*a* so as to supportingly underlie the corresponding edge of sheet 72. Preferably, support members 74 extend completely between adjacent ones of the cross members 28A and are secured thereto such as by welding. As shown in FIG. 6, upper flanges 24 of end members 20 of the frame are also provided with support members 74 having a leg 76 secured to the underside of the upper flange 24 of the corresponding end member and a leg 78 extending inwardly of the frame so as to underlie the corresponding end edge of the deck sheet 72. The support members 74 on end members 20 of the frame preferably are coextensive with the end frame member to enhance support of the deck sheet 72 against flexure under the weight of a person or object thereon.

It will be appreciated from the foregoing description of FIG. 6 and the description of the earlier embodiment, that the upper flanges 32*a* of cross members 28A and the inner side edges 24*a* of upper flanges 24 of the side and end frame members provide the frame with a recessed portion in which deck unit or units 16A rest. It will likewise be appreciated that sliding displacement of the deck unit or units in the direction between the opposite sides and ends of the frame is restrained by engagement between the side and end edges of deck sheet 72 and inner edges 24*a* of upper flanges 24 of the side and end members.

While considerable emphasis has been placed on the preferred embodiments herein illustrated and described, it will be appreciated that many embodiments of the invention can be made and that many changes can be made in the embodiments disclosed herein without departing from the principles of the present invention. In this respect, for example, the deck structure can be of any desired size, smaller or larger than referred to herein and can include more or less than the three deck units described. Further, the deck units can be constructed of of material other than wood, and the frame can be constructed of wood rather than metal. Accordingly, it is to be distinctly understood that the foregoing descriptive matter is to be interpreted merely as illustrative of the invention and not as a limitation.

Having thus described the invention, it is claimed:

1. A deck structure for a floating dock comprising frame means and deck means, said frame means having opposite ends and opposite sides, support means, and upper surface means, said opposite ends extending between said opposite sides, each said opposite end and opposite side including a top surface, said support means comprising support members on each said opposite end and opposite side, each said support member having a horizontal leg spaced below said top surface of the corresponding one of said opposite ends and opposite sides, said deck means having opposite side edges and opposite end edges, said deck means resting on said upper surface means and on said horizontal legs of said support members, said legs of said support members directly underlying the corresponding ones of said opposite side edges and opposite end edges, said deck means being removable from said frame means as a unit, and said frame means including means for restraining displacement of said deck means relative thereto in the directions between said opposite ends and sides.

2. A deck structure according to claim 1, wherein said deck means includes stringers extending in the direction between said opposite ends and deck members overlying and secured to said stringers to provide a deck unit.

3. A deck structure according to claim 2, wherein said stringers and deck members are wood.

4. A deck structure according to claim 1, wherein said frame means includes means providing an upwardly open recess having bottom means and wall means along said opposite ends and opposite sides, said bottom means providing said upper surface means and said wall means providing said means for restraining displacement of said deck means.

5. A deck structure according to claim 4, wherein said deck means includes stringers extending in the direction between said opposite ends and deck members overlying and secured to said stringers to provide a deck unit, said stringers and deck members having opposite ends respectively adjacent and facing said wall means along said opposite ends and opposite sides and providing said opposite side edges and opposite end edges of said deck means.

6. A deck structure according to claim 5, wherein said stringers and deck members are wood.

7. A deck structure according to claim 4, wherein said deck means includes sheet wood means, said opposite end edges and opposite side edges respectively being adjacent and facing said wall means along said opposite ends and opposite sides.

8. A deck structure for a floating dock comprising frame means including spaced apart side member means having opposite ends and end member means extending between and connecting said side member means at each of said opposite ends, said side and end member means having corresponding top surface means and corresponding support means thereon below said top surface means, cross member means separate from said support means and extending between said side member means, said cross member means being spaced apart in the direction between said end member means and having upper surface means spaced below said top surface means, said support means comprising support members each having a horizontal leg spaced below said top surface means of the corresponding side and end member means, and deck means resting on said upper surface means of said cross member means and having outside edge means resting upon said legs of said support members, said deck means being removable from said frame means as a unit.

9. A deck structure according to claim 8, wherein said deck means includes wood stringer members extending in the direction between said end member means and spaced apart in the direction between said side member means and wood deck boards overlying and secured to said stringer members to provide a deck unit, said stringer members having lower ends engaging said upper surface means of said cross member means, and said deck boards having top surfaces generally coplanar with said top surface means.

10. A deck structure according to claim 8, wherein said outside edges of said deck means include opposite side edges each adjacent a corresponding one of said side member means, the legs of the corresponding support member for each said side member means underlying the corresponding side edge of said deck means.

11. A deck structure according to claim 10, wherein said outside edges of said deck means further include opposite end edges each adjacent a corresponding one of said end member means, the leg of the corresponding support member for each said end member means underlying the corresponding end edge of said deck means.

12. A deck structure according to claim 11, wherein said legs of said support members on said side and end member means are generally coplanar with said upper surface means of said cross member.

13. A deck structure according to claim 12, wherein said deck means includes sheet wood means having an underside engaging said legs of said support members on said side and end member means and said upper surface means of said cross member means.

14. A deck structure for a floating dock comprised frame means including spaced apart side member means having opposite ends and end member means between said side member means at each of said opposite ends, said side and end member means having corresponding top surface means, cross member means between said side member means, said cross member means being spaced apart in the direction between said end member means and having upper surface means spaced below said top surface means, and deck means resting on said upper surface means of said cross member means and being removable from said frame means as a unit, said deck means having opposite side edges each adjacent a corresponding one of said side member means, each said side member means including support means underlying the corresponding side edge of said deck means, said deck means further having opposite end means each adjacent a corresponding one of said end member means, each said end member means including support means underlying the corresponding end means of said deck means, said support means on said end member means being coplanar with said upper surface means of said cross member means, and said support means on said side member means being spaced above said upper surface means of said cross member means.

15. A deck structure according to claim 14, wherein said deck means includes wood stringer members extending in the direction between said end member means and wood deck boards overlying and secured to said stringer members to provide a deck unit, said deck boards having opposite ends providing said opposite side edges of said deck means, said stringer members having lower ends engaging said upper surface means of said cross member means, and said opposite ends of said deck boards having bottom sides engaging said support means on said side member means.

16. A deck structure according to claim 15, wherein said opposite end means of said deck means includes ends of said stringer members adjacent said end member means, said support means on said end member means underlying the corresponding ends of said stringer members.

17. A deck structure according to claim 8, wherein at least one of said side member means and end member means has a utility access opening therethrough to the interior of said frame means below said deck means.

18. A deck structure for a floating dock comprising, frame means and deck means, said frame means having laterally opposite sides and longitudinally opposite ends respectively defined by side and end channel members opening inwardly of said frame means and having upper and lower flanges and a web therebetween, a plurality of cross members spaced apart in the direction between said end members and extending between said side members, said cross members having upper ends spaced below said upper flanges of said side and end members, support members on said upper flanges of said side members and extending downwardly therefrom and inwardly of said frame means, said support members having a leg spaced below said upper flanges of said side members, said deck resting on said upper ends of said cross members and on said legs of said support members.

19. A deck structure according to claim 18, wherein said upper flanges of said side and end members are coplanar and said deck means is wood and has an upper surface generally coplanar with said upper flanges of said side and end members.

20. A deck structure according to claim 18, wherein said support members are first support members, and second support members on said upper flanges of said end members and extending downwardly therefrom and inwardly of said frame means, said second support members having a leg spaced below said upper flanges of said end members, said deck means also resting on said legs of said second support members.

21. A deck structure according to claim 18, wherein said cross members are channel members having upper and lower flanges and a web therebetween, said upper flanges of said cross members being spaced below said upper flanges of said side and end members and providing said upper ends of said cross members.

22. A deck structure according to claim 21, wherein the web of at least one of said side and end members has a utility opening therethrough to the interior of said frame means and the webs of said cross members having utility openings therethrough.

23. A deck structure according to claim 22, and utility support trough means between the utility openings through the webs of said cross members.

24. A deck structure according to claim 18, wherein said deck means includes wood stringer members extending in the direction between said end members and wood deck boards overlying said stringer members and extending in the direction between said side members, said deck boards being fastened to said stringer members to provide a deck unit, said stringer members resting on said upper ends of said cross members, and said deck boards having opposite ends resting on said legs of said support members.

25. A deck structure according to claim 24, wherein said upper flanges of said side and end members are coplanar and said deck boards provide said deck unit with an upper surface generally coplanar with said upper flanges of said side and end members.

26. A deck structure according to claim 24, wherein said support members are first support members, and second support members on said upper flanges of said end members and extending downwardly therefrom and inwardly of said frame means, said second support members having a leg spaced below said upper flanges of said end members, and said stringer members having ends resting on said legs of said second support members.

27. A deck structure according to claim 26, wherein said cross members are channel members having upper and lower flanges and a web therebetween, said upper flanges of said cross members being spaced below said upper flanges of said side and end members and providing said upper ends of said cross members.

28. A deck structure according to claim 27, wherein the web of at least one of said side and end members has a utility opening therethrough to the interior of said frame means and the webs of said cross members having utility openings therethrough.

29. A deck structure according to claim 28, and utility support trough means between the utility openings through the webs of said cross members.

30. A deck structure according to claim 29, wherein said upper flanges of said side and end members are coplanar and said deck boards provide said deck unit with an upper surface generally coplanar with said upper flanges of said side and end members.

31. A deck structure according to claim 18, wherein said deck means includes generally planar wood sheet means resting on said upper ends of said cross members and having side edges adjacent said side channel members and resting on said legs of said support members.

32. A deck structure according to claim 31, wherein said upper flanges of said side and end members are coplanar, and said wood sheet means has upper surface means coplanar with said upper flanges.

33. A deck structure according to claim 31, wherein said support members on said upper flanges of said side members are first support members, second support members on said upper flanges of said end members and extending downwardly therefrom and inwardly of said frame means, said second support members having a leg spaced below said upper flanges of said end members, and said sheet means having end edges resting on the legs of said second support members.

34. A deck structure according to claim 33, wherein said cross members are channel members having upper and lower flanges and a web therebetween, said upper flanges of said cross members being spaced below said upper flanges of said side and end members and providing said upper ends of said cross members.

35. A deck structure according to claim 34, wherein the web of at least one of said side and end members has a utility opening therethrough to the interior of said frame means and the webs of said cross members having utility openings therethrough.

36. A deck structure according to claim 35, and utility support trough means between the utility openings through the webs of said cross members.

37. A deck structure according to claim 36, wherein said upper flanges of said side and end members are coplanar, and said wood sheet means has upper surface means coplanar with said upper flanges.

* * * * *